US006848960B2

(12) United States Patent
Minami et al.

(10) Patent No.: US 6,848,960 B2
(45) Date of Patent: Feb. 1, 2005

(54) METHOD FOR MANUFACTURING COLOR SELECTION ELECTRODE STRUCTURE AND COLOR CATHODE RAY TUBE HAVING THE COLOR SELECTION ELECTRODE STRUCTURE

(75) Inventors: Go Minami, Takatsuki (JP); Shiro Kashihara, Moriyama (JP); Shigenari Ohshima, Rittou (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 14 days.

(21) Appl. No.: 10/176,569

(22) Filed: Jun. 21, 2002

(65) Prior Publication Data

US 2002/0195921 A1 Dec. 26, 2002

(30) Foreign Application Priority Data

Jun. 21, 2001 (JP) ..... 2001-187728

(51) Int. Cl.[7] ..... F23Q 23/08; F23Q 23/10; H01T 21/06

(52) U.S. Cl. ..... 445/3; 445/35; 445/36; 445/37; 445/47; 445/64; 73/862.381; 73/862.391; 73/862.451; 73/862.621

(58) Field of Search ..... 445/35, 36, 37, 445/47, 3, 64; 73/862.381, 862.391, 862.451, 862.473, 862.392, 862.621, 862.624

(56) References Cited

U.S. PATENT DOCUMENTS 4,887,988 A 12/1989 Canevazzi et al. ..... 445/37
5,251,491 A * 10/1993 Nakaoka et al. ..... 73/862.41

FOREIGN PATENT DOCUMENTS

| | | | | |
|---|---|---|---|---|
| EP | 0278831 | | 8/1988 | |
| EP | 0 984 482 | | 3/2000 | |
| EP | 1001447 | | 5/2000 | |
| JP | 8-15063 | | 1/1996 | |
| JP | 2000-162064 | | 6/2000 | |
| JP | 2000162064 A | * | 6/2000 | ..... G01L/5/04 |
| JP | 2000-180278 | | 6/2000 | |
| JP | 2000180278 A | * | 6/2000 | ..... G01L/5/04 |
| JP | 2000-357458 | | 12/2000 | |
| JP | 2002228530 A | * | 8/2002 | ..... G01L/5/10 |

* cited by examiner

*Primary Examiner*—Nimeshkumar D. Patel
*Assistant Examiner*—Mariceli Santiago

(57) ABSTRACT

To provide a method for manufacturing a color selection electrode structure easily capable of measuring a tension amount of the color selection electrode in the process for manufacturing the color selection electrode structure and a color cathode ray tube using the color selection electrode structure. The color selection electrode is stretched with tension applied in the direction of the shorter axis thereof, and welded and fixed onto the top face that is curved inwardly in the direction of the longer axis of the longer side members. Thereafter, the weight is placed on the color selection electrode so as to allow the color selection electrode to deflect by the load due to the mass of the weight. The deflection amount of the color selection electrode may be measured by using a laser displacement meter and the measured deflection amount of the measured color selection electrode is converted into the tension amount by the correlation graph. Thus, even if shock is applied from the outside, a color cathode ray tube without defects of color misalignment can be obtained.

12 Claims, 7 Drawing Sheets

METHOD FOR MANUFACTURING COLOR SELECTION ELECTRODE STRUCTURE AND COLOR CATHODE RAY TUBE HAVING THE COLOR SELECTION ELECTRODE STRUCTURE

BACKGROUND OF THE INVENTION

1. Field of the Invention

The present invention relates to a method for manufacturing a color selection electrode structure used for television, computer displays, and the like, and a color cathode ray tube having the color selection electrode structure.

2. Description of the Related Art

In general, a color cathode ray tube has a color selection electrode structure including a color selection electrode for carrying out color selection with respect to three electron beams emitted from an electron gun and a frame for holding the color selection electrode.

Recently, for the color selection electrode structure, a tension mask such as a one-dimensional tension mask and a two-dimensional tension mask, etc. has been employed. Such tension masks are formed by stretching and welding the color selection electrode onto the frame in a state in which tension (tensile force) is applied to a color selection electrode, which is a flat plate member having a large number of apertures, in one direction or both directions from the shorter axis and the direction of the longer axis of the color selection electrode.

For example, as shown in FIG. 7, a color selection electrode structure 100 of the one-dimensional tension mask is manufactured as follows. That is, a color selection electrode 103 having a plurality of apertures 102 is stretched in the direction of the shorter axis (in the direction shown by an arrow 104) in a state in which a frame 101 is pressed and deformed, and welded and fixed onto the frame 101, followed by releasing the pressure applied to the frame 101 so as to apply tension to the color selection electrode 103. Thereafter, an elastic supporting body 105 is welded and fixed onto the frame 101 to which the color selection electrode 103 is held with stretched.

Then, the color selection electrode structure 100 is incorporated into a panel (not shown in the drawings) of the color cathode ray tube after the heat treatment at 450° C. for removing any distortion that remained on the welded portion of the color selection electrode structure 100.

However, in a conventional method for manufacturing the color selection electrode structure 100, the color selection electrode structure 100 formed by stretching with tension applied had problems due to variation in strength depending upon materials of the frame 101 and the color selection electrode 103 and variation in the tension amount of the individual color selection electrode structures 100 depending upon the accuracy in the apertures 102 provided on the color selection electrode 103 or the processing accuracy of the frame 101, etc. Furthermore, by the subsequent heat treatment, because the change of the material property is added due to the high temperature creep, the variation in the tension amount becomes larger.

Some of the color selection electrode structures 100 cannot obtain the necessary tension amount. When the color selection electrode 100 cannot obtain the necessary tension amount and the tension amount is small, if shock, etc. is applied from the outside to the color selection electrode structure 100, the vibration of the color selection electrode 103 is increased. Therefore, in a color cathode ray tube using the color selection electrode structure 100 having a small tension amount, the defect of color misalignment occurs, which may cause deterioration of the quality of a color cathode ray tube.

The presence of the color selection electrode that cannot sufficiently obtain the tension amount may cause the relative deterioration of the quality of the color selection electrode structure and in turn the deterioration of the color cathode ray tube. Consequently, the reliability of a color selection electrode and the color cathode ray tube as a product may be deteriorated.

Therefore, in the manufacturing process of the color selection electrode structure, although it is important to measure and understand the tension amount applied to the color selection electrode structure in order to maintain the reliability and the quality of the color selection electrode, no useful means for measuring the tension amount of the color selection electrode structure have been available.

SUMMARY OF THE INVENTION

With the foregoing in mind, it is an object of the present invention to provide a method for manufacturing a color selection electrode capable of easily measuring a tension amount of the color selection electrode in the process for manufacturing the color selection electrode structure, and a color cathode ray tube using the color selection electrode structure.

In order to achieve the above-mentioned object, the present invention provides a method for manufacturing a color selection electrode structure including a substantially rectangular-shaped color selection electrode having a plurality of apertures, and a frame for holding the color selection electrode. The method includes applying tension to the color selection electrode in at least one direction from the direction of the shorter axis and the direction of the longer axis, thereby fixing the color selection electrode onto the frame; and allowing the color selection electrode to deflect by a load application means and determining the tension amount applied to the color selection electrode structure from the deflection amount of the color selection electrode.

Thus, since the tension amount of the color selection electrode can be determined easily, the color selection electrode structure having the tension amount that does not satisfy the specified value can be eliminated as defective. Consequently, it is possible to obtain a color selection electrode structure with high reliability and a color cathode ray tube.

Furthermore, it is preferable that the tension amount applied to the color selection electrode structure is determined based on previously determined correlation data between the deflection amount and the tension amount of the color selection electrode structure. Thus, the deflection amount can be converted into the tension amount rapidly.

Furthermore, it is preferable that the load application means is a weight. Thus, since it is possible to deflect the color selection electrode easily by using a cheap weight so as to determine the tension amount, the entire manufacturing cost can be prevented from significantly increasing.

Furthermore, it is preferable that a mass of the weight is in the range from 10 grams to 150 grams. Thus, the color selection electrode is not deformed due to the load by the weight, and on the other hand a sufficient deflection amount is obtained and the tension amount applied to the color selection electrode structure can be measured by the sufficient deflection amount.

Furthermore, it is preferable that the weight has a cylindrical shape. Thus, the color selection electrode is not likely to be damaged and it is possible to place the weight on the color selection electrode with good balance.

Furthermore, it is preferable that a through hole is provided in the vicinity of the central portion from the top surface to the bottom surface of the weight. Thus, when the deflection amount of the color selection electrode is measured by using a laser displacement meter, since the vicinity of the central portion of the weight can be irradiated with a laser beam, the tension amount of the deflected color selection electrode can be measured with high accuracy.

Furthermore, it is preferable that the deflection amount of the color selection electrode is determined by irradiating the color selection electrode with a laser beam passing through the through hole in a state in which the weight is placed on the color selection electrode. Thus, the tension amount of the deflected color selection electrode can be measured with high accuracy.

Furthermore, it is preferable that the weight is provided with a knob. Thus, since it is possible to grasp the knob portion by the hand or a weight removing device, the weight of the color selection electrode can be removed easily.

Next, a color cathode ray tube of the present invention includes the color selection electrode structure manufactured by the method for manufacturing the above-mentioned color selection electrode structure. In the cathode ray tube, the color selection electrode structure is arranged in an outer surrounding housing composed of a panel with a phosphor screen formed on the inside surface thereof and a funnel with facing the phosphor screen in the vicinity thereof, and the frame of the color selection electrode structure is jointed together with a panel pin of the panel via an elastic supporting body.

Thus, even if shock is applied from the outside, a color cathode ray tube without any defects of color misalignment can be obtained.

DETAILED DESCRIPTION OF THE INVENTION

Hereinafter, a method for manufacturing a color selection electrode structure according to the embodiment of the present invention and a color cathode ray tube using the color selection electrode structure will be explained with reference to FIGS. 1 to 6.

First, the color cathode ray tube according to the embodiment of the present invention will be explained with reference to FIG. 1.

Figure 1:
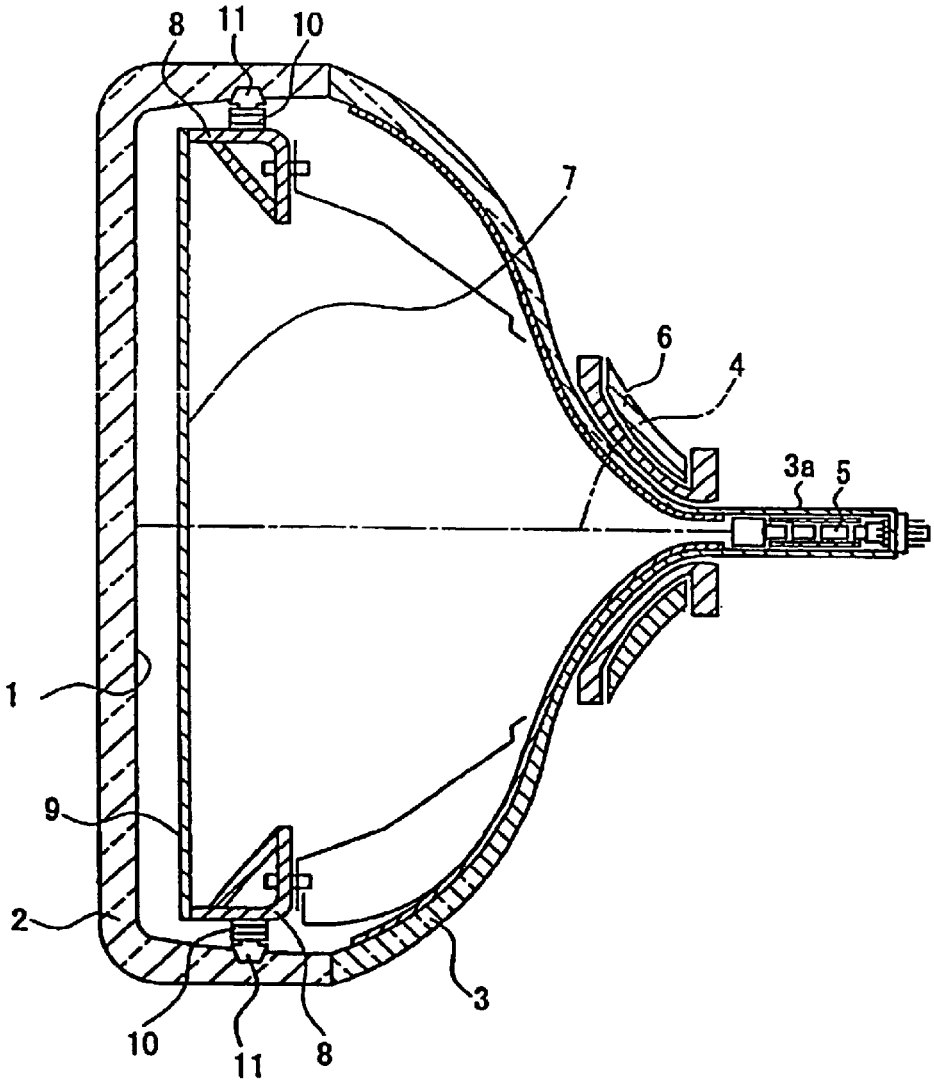
FIG. 1 PRIOR ART
FIG. 1 is a side cross-sectional view showing a color cathode ray tube according to one embodiment of the present invention.

As shown in FIG. 1, a color cathode ray tube according to the present invention includes a glass panel 2 with a phosphor screen 1 formed on the inside surface thereof, a glass funnel 3 connected to the rear side of the panel 2 and an electron gun 5 for emitting electron beams 4 provided in a neck portion 3*a* of the funnel 3. The glass panel 2 and the glass funnel 3 form an outer surrounding housing. Furthermore, on the outer circumference of the funnel 3 of the color cathode ray tube, a deflection yoke 6 for deflecting electron beams 4 emitted from the electron gun 5 is attached.

On the inside surface of the panel 2, three colors of phosphor dots or phosphor stripes are applied, thereby forming a phosphor screen 1. A flat-shaped color selection electrode 7 is placed substantially in parallel with this phosphor screen 1. The color selection electrode 7 has a large number of apertures, which are formed by etching a flat plate and are arranged regularly. The color selection electrode 7 functions as a color selection with respect to three electron beams 4 emitted from the electron gun 5. The color selection electrode 7 is held by the frame 8 and forms the color selection electrode structure 9.

The elastic supporting body 10 attached to the frame 8 is fitted into the panel pin 11 provided in the panel 2. Thereby the color selection electrode structure 9 is joined together with the outer surrounding housing.

Next, a method for manufacturing the color selection electrode structure according to the embodiment of the present invention will be explained with reference to FIG. 2.

Figure 2A:
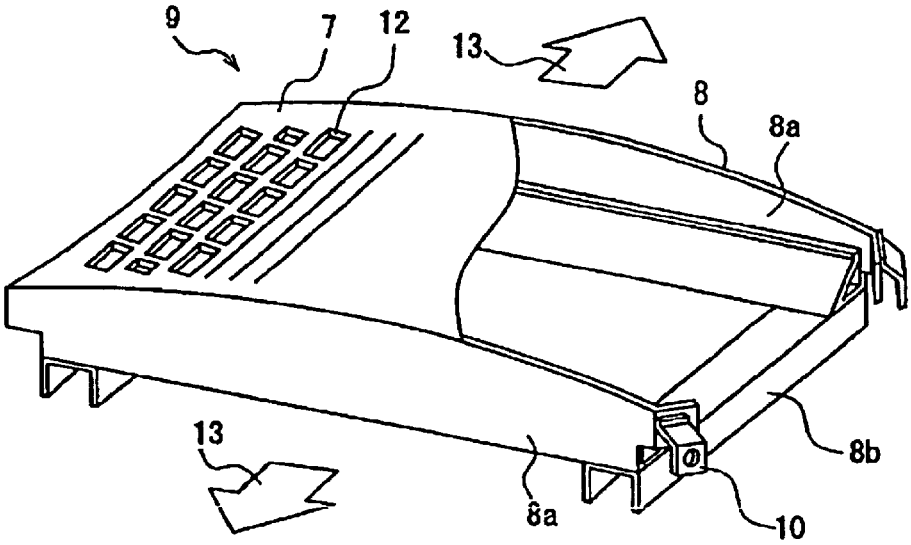
FIG. 2A is a partially cut-away perspective view showing a process for stretching a color selection electrode according to one embodiment of the present invention.

First, both side faces of longer side members 8*a* of the frame 8 are compressed inwardly (in the direction opposite to the direction shown by an arrow 13) while respectively applying a predetermined distributed load within the elastic range at three to nine pressing points. In this embodiment, the frame was compressed while applying a load of 3432.3 N in total for seven points on each side. As shown in FIG. 2A, a color selection electrode 7 is stretched while applying tension of about 1961.3 N in total in the direction of the shorter axis thereof (in the direction shown by an arrow 13) as the frame compressed as mentioned above, and welded and fixed onto the top face that is curved inwardly in the direction of the longer axis of the longer side members 8*a*. Thereafter, the load applied to the longer side members 8*a* is removed and at the same time the tensile force to the color selection electrode 7 is released. As a result, the state in which a predetermined tension is applied to the color selection electrode 7 is obtained.

Note here that the frame 8 may be formed of a pair of longer side members 8*a* having a substantially triangleshaped cross section and a pair of a shorter side members 8*b* having a rectangular U-shaped cross section. The front surface (the surface onto which the color selection electrode 7 is welded) of each of the pair of the longer side member 8*a* is a curved face (cylindrical face) protruding toward the side of a phosphor screen with a predetermined radius of curvature. Therefore, the color selection electrode 7 is fixed to the frame 8 with curved along the longer axis direction.

Figure 2B:
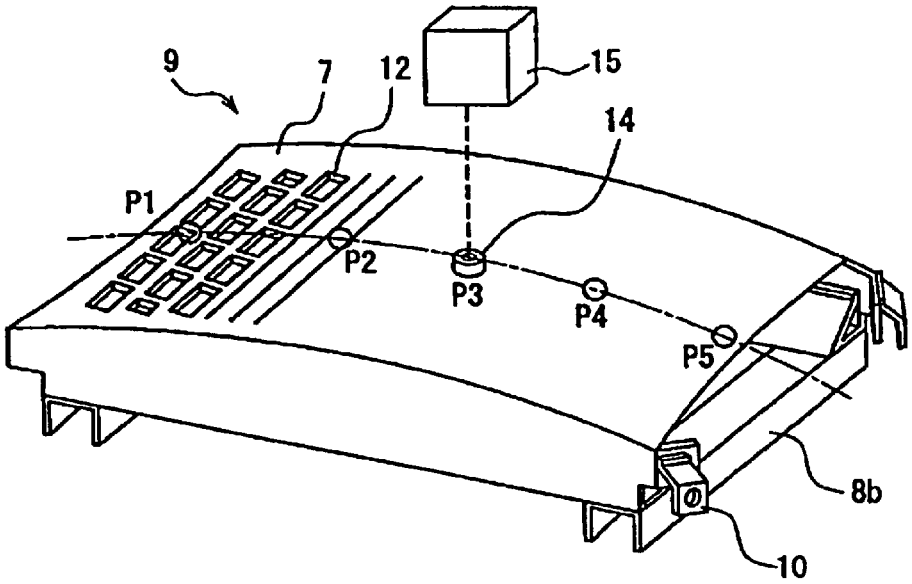
FIG. 2B is a perspective view showing a process for measuring a deflection amount of a color selection electrode according to one embodiment of the present invention.

Next, as shown in FIG. 2B, a weight 14 as the load application means, for example, having a mass of 30 grams, was placed on the color selection electrode 7 so as to allow the color selection electrode 7 to deflect by a load due to the gravity of the weight 14. Then the deflection amount of the color selection electrode 7 was measured by using a laser displacement meter 15.

In the case of the color selection electrode structure for a 68-cm (29-inch) diagonal cathode ray tube for television, as shown in FIG. 2B, the deflection amount was measured at five points (P1 to P5) along the longer axis direction in the center of the direction of the shorter axis of the color selection electrode 7. The reason why five points were measured as mentioned above is because in order to reduce the vibration amount of the color selection electrode 7 due to the shock, etc. from the outside and to stop the vibration quickly, the color selection electrode 7 preferably shows the variation in which a tension amount is large at the central portion (P3) and gradually reduced toward the end portions along the longer axis direction and the balance between right and left is maintained.

Furthermore, in order to know whether the tension amount shows such a gradually changing variation with being symmetrical in right and left, it is preferable that measurement is carried out for at least five points including one point in the central portion, two points near the end portions and two points near the middle points between the central portion and the end portions along the longer axis direction.

Figure 3:
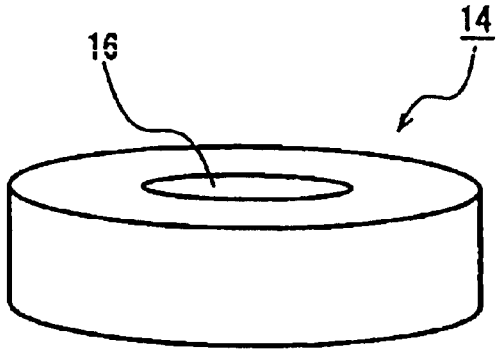
FIG. 3 is a perspective view showing a weight used for a method for manufacturing a color selection electrode according to one embodiment of the present invention.

As shown in FIG. 3, the weight used in this embodiment may have a cylindrical shape with a diameter of the upper face and the lower face of about 30 mm and the height of about 10 mm and is provided with a cylindrical-shaped through hole 16 with a diameter of about 10 mm from the upper face to the lower face. The reason why the deflection amount was measured by providing through hole 16 is because the color selection electrode 7 can be irradiated directly with a laser beam.

Figure 4A:
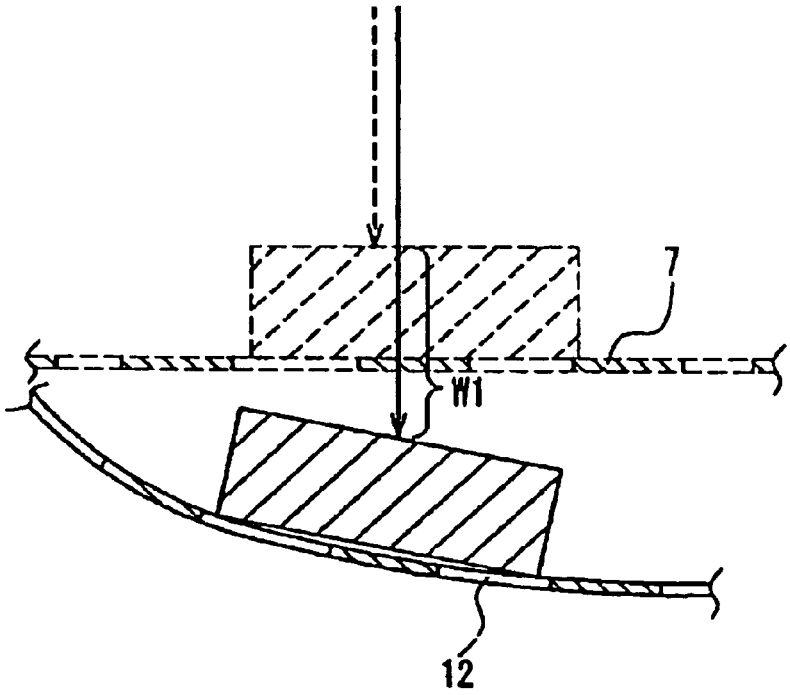
FIG. 4A is a cross-sectional view of a color selection electrode and a weight showing the displacement of the color selection electrode when a deflection amount is measured without providing the weight with a through hole.
Figure 4B:
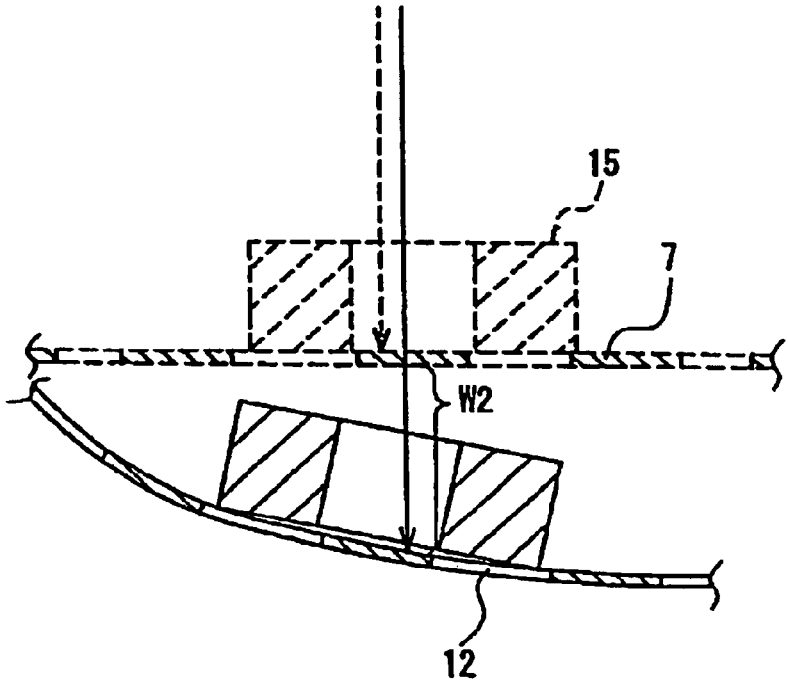
FIG. 4B is a cross-sectional view of a selection electrode and a weight showing the displacement of the color selection electrode when a deflection amount is measured with providing the weight with through hole according to the embodiment of the present invention.

The following is an explanation of the comparison between the case where the weight is provided with the through hole 16 and the case where the weight is not provided with the through hole 16 with reference to FIG. 4. As shown in FIG. 4A, when the deflection amount is measured without providing the weight with the through hole 16, the deflection amount W1 shows a displacement of the upper surface of the weight. When the deflection amount is measured by providing the weight with the through hole 16 as in the embodiment of the present invention as shown in FIG. 4B, the deflection amount W2 shows an actual displacement of the color selection electrode 7.

The comparison result shows that W1 includes a measurement error with respect to W2 by an amount in which the weight inclines due to the deflection of the color selection electrode. This error is observed remarkably for the measurement points toward the end of the color selection electrode 7 (for example, P1 and P5 in FIG. 2B).

Figure 5:
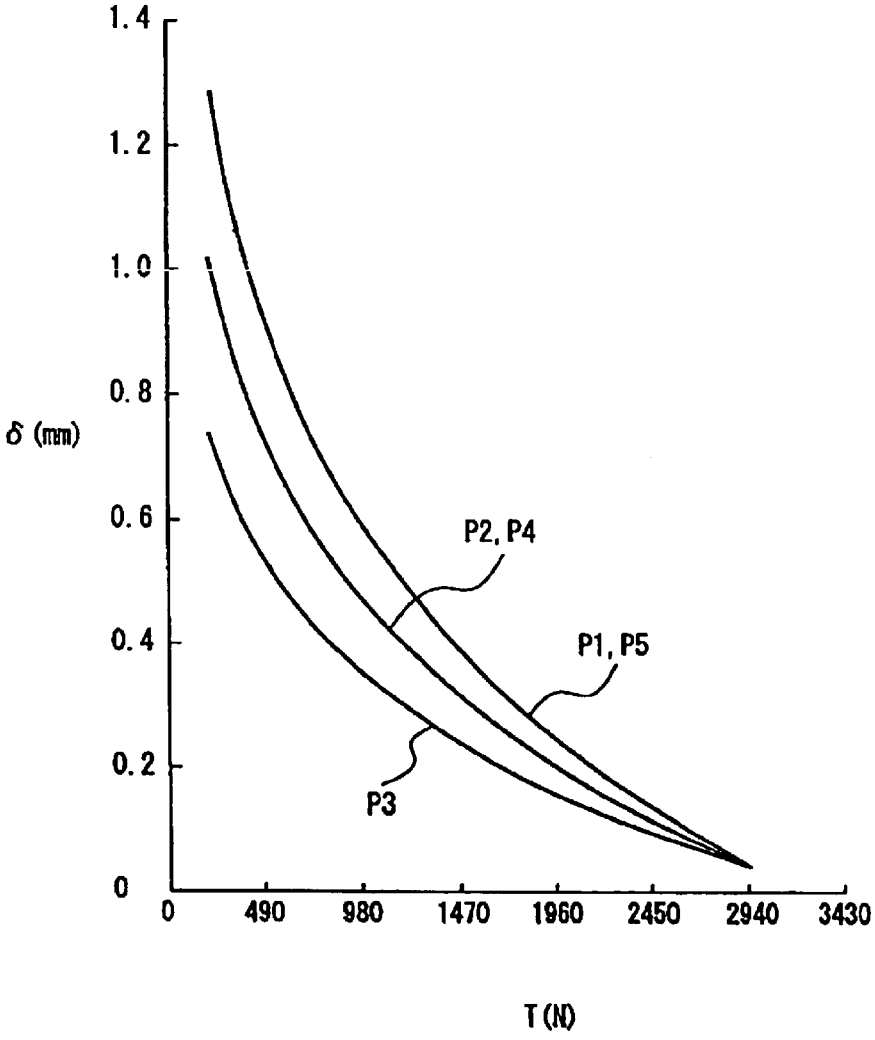
FIG. 5 is a graph showing the correlation between a deflection amount and a tension amount in the method for manufacturing a color selection electrode according to one embodiment of the present invention.

Next, the deflection amount of the color selection electrode 7 measured in the above is converted into the tension amount. This conversion is carried out as follows: besides the manufacture of mass-produced color selection electrode structures, the deflection amount of the color selection electrode is measured sufficiently in advance when a predetermined weight is placed on the color selection electrode with a constant tension applied by using a stretching device, and then the average value of the measurement values of the deflection amount is calculated. Then, as shown in FIG. 5, for example, a graph showing the correlation between the deflection amount δ (mm) and the tension amount T (N) was formed.

Note here that since the correlation between the deflection amount and the tension amount is different depending upon the measuring position of the color selection electrode 7, it is preferable that the correlation graph is formed for each measurement position by making the measurement position of tension to be constant.

Herein, the color selection electrode structures 9 in which the converted tension amount does not satisfy the predetermined value are eliminated from the manufacturing process as defective because the vibration amount of the color selection electrode 7 due to the shock from the outside, etc. becomes large, so that the color misalignment occurs in the color cathode ray tube.

Next, the elastic supporting bodies 10 are welded and fixed to four corners of the color selection electrode structure 9 to which tension is applied, followed by a heat treatment at 450° C. in order to remove any distortion of materials or welded portions.

Then, by measuring the tension amount of the color selection electrode 7 again after heat treatment, a more reliable color selection electrode structure 9 can be obtained.

Note here that in this embodiment, as one example, a color selection electrode structure used for a 68-cm (29-inch) diagonal cathode ray tube for television was manufactured. An example of a specification of each component will be explained hereinafter.

The color selection electrode 7 has a plate thickness of 0.1 mm, is made of Fe, 42% Ni—Fe, 36% Ni—Fe, or the like, and is provided with a large number of apertures 12 having a substantially elliptical shape or substantially rectangular shape. These apertures 12 are arranged in predetermined pitches and distribution. The region provided with apertures has a substantially rectangular shape having a size of 384 mm (length)×509 mm (width).

The frame 8 is formed of a pair of longer side members 8*a* having a substantially triangular-shaped cross section and a pair of shorter side members 8*b* having a rectangular U-shaped cross section which are adhered to each other. The longer side members 8*a* have a plate thickness of 1.4 mm and are made of 36% Ni—Fe. The shorter side members 8*b* have a plate thickness of 1.4 mm and are made of 42% Ni—Fe. The formed frame has a size of 414 mm (length)× 534 mm (width).

Furthermore, in this embodiment, a weight having a mass of 30 grams was used as the load application means, however, the means is not necessarily limited to this. It is necessary to appropriately select a weight having a mass in accordance with the tension amount because the necessary tension amount is different depending upon the kinds of the color cathode ray tubes.

In the cathode ray tube approximately having a small tension amount, it is preferable to select a weight with a light mass, and on the contrary, in the cathode ray tube having a large tension amount, it is preferable to select the weight having a heavy mass.

Furthermore, as a result of the various kinds of color cathode ray tubes, it is preferable to use as heavy a weight as possible of about 80 to 120 grams because distribution of measurement tends to be small. However, if the weight is too heavy, the color selection electrode 7 is folded or deformed and therefore, the upper limit of the mass of the weight generally will be 150 grams. Furthermore, in order to obtain the sufficient deflection amount, the mass of the weight is preferably 10 grams or more.

Figure 6A:
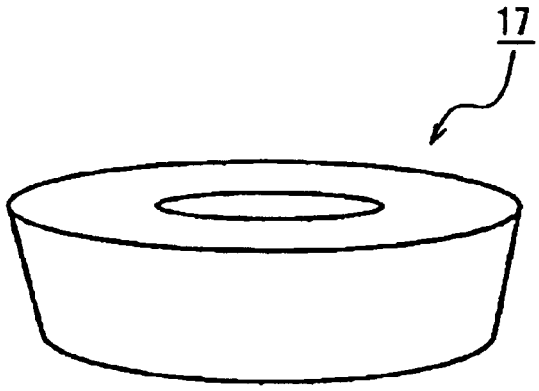
FIG. 6A is a perspective view showing a modification of a weight according to one embodiment of the present invention.
Figure 6B:
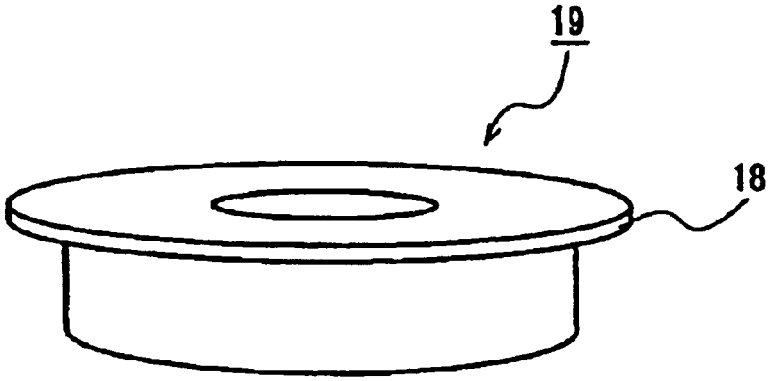
FIG. 6B is a perspective view showing a modification of a weight according to another embodiment of the present invention.
Figure 7:
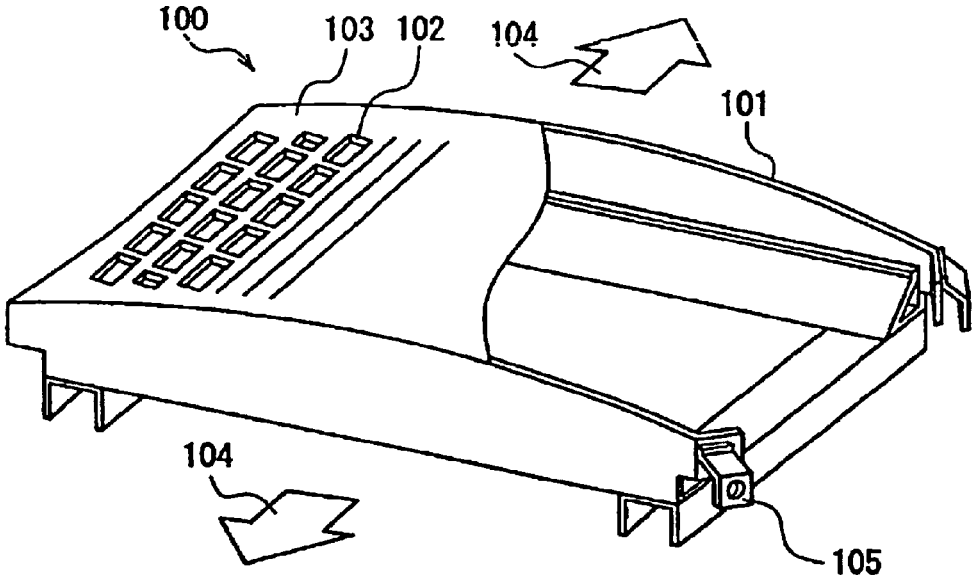
FIG. 7 PRIOR ART
FIG. 7 is a partially cut-away perspective view showing a color selection electrode in an example of a conventional method for manufacturing a color selection electrode.

Furthermore, in this embodiment of the present invention, the weight having a cylindrical shape was used, however the shape is not necessarily limited to this shape. As shown in FIG. 6A, a trapezoid column shaped weight 17 may be used by placing it with a small area surface facing the bottom. Also, as shown in FIG. 6B, a knob 18 such as a brim etc. is provided in the peripheral portion of the upper circumference of the cylindrical column shaped weight, allowing the weight to be grasped easily. Thus, it is possible to remove the weight from the color selection electrode 7 by the hand or by using a weight removing device easily.

In this embodiment, a weight is used as the load application means, however, it may be possible to apply load to the color selection electrode 7 by the use of a load application means such as a load application apparatus, etc.

Furthermore, the measurement of the deflection amount of the color selection electrode by the use of the load application means in this embodiment can be applied for the inspection such as rot inspection etc. or test for shock resistance test, etc., and also used for inspection method or testing method of the color selection electrode or color cathode ray tube.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for manufacturing a color selection electrode structure comprising a substantially rectangular-shaped color selection electrode having a plurality of apertures, and a frame for holding the color selection electrode, the method comprising applying tension to the color selection electrode in at least one direction from the direction of the shorter axis and the direction of the longer axis, thereby fixing the color selection electrode onto the frame, and allowing the color selection electrode to deflect by application of a load and determining the tension amount applied to the color selection electrode from the deflection amount of a plurality of points of the color selection electrode.

2. The method according to claim 1, wherein the tension amount applied to the color selection electrode is determined based on previously determined correlation data between the deflection amount and the tension amount of the color selection electrode structure.

3. The method according to claim 1, wherein the load is applied by a weight.

4. The method according to claim 3, wherein a mass of the weight is in the range from 10 grams to 150 grams.

5. The method according to claim 3, wherein the weight has a cylindrical shape.

6. The method according to claim 5, wherein a through hole is provided in the vicinity of the central portion from the top surface to the bottom surface of the weight.

7. The method according to claim 6, wherein the deflection amount of the color selection electrode is determined by irradiating the color selection electrode with a laser beam passing through the through hole in a state in which the weight is placed on the color selection electrode.

8. The method according to claim 3, wherein the weight is provided with a knob.

9. A color cathode ray tube comprising the color selection electrode structure manufactured by the method described in claim 1, wherein the color selection electrode structure is arranged in an outer surrounding housing composed of a panel with a phosphor screen formed on the inside surface thereof and a funnel with facing the phosphor screen in the vicinity thereof, and the frame of the color selection electrode structure is jointed together with a panel pin of the panel via an elastic supporting body.

10. The method according to claim 1, wherein the deflection amount of the plurality of points is a deflection amount measured at five points or more along the longer axis direction of the color selection electrode.

11. The method according to claim 10, wherein the points for measuring the deflection amount comprise one point in the central portion, two points near the end portions, and two points near the middle points between the central portion and the end portions along the longer axis direction.

12. A method for manufacturing a color selection electrode structure comprising a substantially rectangular-shaped color selection electrode having a plurality of apertures, and a frame for holding the color selection electrode, the method comprising:

applying tension to the color selection electrode in at least one direction from the direction of the shorter axis and the direction of the longer axis of the color selection electrode, thereby fixing the color selection electrode onto the frame; and allowing the color selection electrode to deflect by application of a weight and determining the tension amount applied to the color selection electrode from the deflection amount of the color selection electrode, wherein a through hole is provided in the vicinity of the central portion from the top surface to the bottom surface of the weight, the deflection amount of the color selection electrode is determined by irradiating the color selection electrode with a laser beam passing through the through hole in a state in which the weight is placed on the color selection electrode, and in a state in which a portion on which the weight is placed on the color selection electrode is an inclined surface, the deflection amount of the color selection electrode is determined by irradiating the inclined surface of the color selection electrode with a laser beam passing through the through hole.

* * * * *